US006470865B2

(12) United States Patent
Iizuka et al.

(10) Patent No.: US 6,470,865 B2
(45) Date of Patent: Oct. 29, 2002

(54) ENGINE CYLINDER HEAD

(75) Inventors: Yoshiaki Iizuka, Saitama (JP); Junji Yamano, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/973,739

(22) Filed: Oct. 11, 2001

(65) Prior Publication Data

US 2002/0043254 A1 Apr. 18, 2002

(30) Foreign Application Priority Data

Oct. 13, 2000 (JP) ..... 2000-312982

(51) Int. Cl.[7] ..... F02M 25/07
(52) U.S. Cl. ..... 123/568.13; 123/193.5
(58) Field of Search ..... 123/568.11, 568.12, 123/568.13, 193.5

(56) References Cited

U.S. PATENT DOCUMENTS

| | | | | |
|---|---|---|---|---|
| 4,106,449 A | * | 8/1978 | Matsumoto et al. | 123/568.12 |
| 4,221,203 A | * | 9/1980 | Hayashi et al. | 123/568.29 |
| 4,328,781 A | * | 5/1982 | Morita | 123/184.39 |
| 4,367,719 A | * | 1/1983 | Kimura et al. | 123/184.41 |
| 4,413,605 A | * | 11/1983 | Leoni | 123/547 |
| 4,579,091 A | | 4/1986 | Kashiwagi et al. | 123/41.82 R |
| 4,643,157 A | * | 2/1987 | Nishikawa et al. | 123/568.13 |
| 4,693,226 A | * | 9/1987 | Choma | 123/568.17 |
| 5,762,051 A | * | 6/1998 | Okamoto | 123/184.31 |
| 5,839,417 A | | 11/1998 | Kwiatkowski et al. | 123/568 |
| 5,979,421 A | * | 11/1999 | Yamashita et al. | 123/568.12 |
| 2002/0005190 A1 | * | 1/2002 | Bianchi | 123/568.12 |

FOREIGN PATENT DOCUMENTS

| | | |
|---|---|---|
| DE | 19642685 A1 * | 4/1998 |
| JP | 63-143754 | 9/1988 |
| JP | 7-247917 | 9/1995 |
| JP | 2000-161131 | 6/2000 |
| JP | 2001-227414 | 8/2001 |

* cited by examiner

*Primary Examiner*—Gene Mancene
*Assistant Examiner*—Arnold Castro
(74) *Attorney, Agent, or Firm*—Armstrong, Westerman & Hattori, LLP

(57) ABSTRACT

An engine cylinder head in which a water jacket and an EGR passage are formed therein, the EGR passage opening into an exhaust passage at one end and opening into a side of an intake side at the other end thereof, the engine cylinder being characterized in that the EGR passage is provided outwardly in a cylinder arrangement direction of head bolt pass-through holes formed in one end of the engine cylinder head in the cylinder arrangement direction. Thus, because the EGR passage can be made much longer, the cooling capacity for re-circulating gas can be improved. Moreover, because the EGR passage can be provided without head bolts being spaced apart from the combustion chamber, the surface pressure around combustion chambers in the cylinder head relative to a cylinder block can be prevented from being lowered.

16 Claims, 3 Drawing Sheets

ENGINE CYLINDER HEAD

BACKGROUND OF THE INVENTION

1. Field of the Invention

The present invention relates to an engine cylinder head in which water jackets and an exhaust gas recirculation passage are formed therein, the engine exhaust gas recirculation passage opening into an exhaust passage at one end and opening into a side surface of an intake side at the other end thereof.

2. Description of the Related Art

It is a common practice to re-circulate a part of exhaust gases from combustion chambers to an intake system path in order to reduce oxides of nitrogen in exhaust gases from the engine. Known as an exhaust gas recirculation passage (hereinafter, referred to as EGR passage) of this type is an exhaust gas recirculation passage drilled in the interior of a cylinder head so as to open to immediately after exhaust ports in a combustion chamber at an upstream end thereof (JP-A-63-143754U).

However, when exhaust gases taken out from immediately after the exhaust ports are recirculated to the intake side by way of the relatively short EGR passage, as illustrated in the above Japanese Utility Model Unexamined Publication, high temperature exhaust gases flow into the intake passage. This can cause early deterioration of an EGR valve or setting of oil and gasoline in blow-by gases in a tar-like fashion to thereby narrow the passage.

It is known to externally attach a cooling device for cooling recirculation gases, but this prevents engines from being made compact and is disadvantageous in cost.

SUMMARY OF THE INVENTION

The invention was made with a view to solving the problems inherent in the prior art technologies, and a main object thereof is to provide an engine cylinder head which can not only secure a sufficient cooling capacity for re-circulating exhaust gases but also is improved such that no reduction in rigidity of the cylinder head is caused, even if an EGR passage is formed therein.

With a view to attaining the object, according to a first aspect of the invention, there is provided an engine cylinder head in which a water jacket (10) and an EGR passage (12) are formed therein, the EGR passage (12) opening into an exhaust passage (7) at one end and opening into a side of an intake side at the other end thereof, the engine cylinder being characterized in that the EGR passage is provided outwardly in a cylinder arrangement direction of head bolt pass-through holes (9) formed in one end of the engine cylinder head in the cylinder arrangement direction.

According to this construction, the EGR passage can be made much longer and moreover the EGR passage can be provided without head bolts being spaced apart from the combustion chamber.

According to a second aspect of the invention, there is provided an engine cylinder head as set forth in the first aspect of the invention, wherein at least a part (a downstream side portion 12*b* in an embodiment) of the EGR passage is formed in a wall (a thick portion 13 in the embodiment) constituting the water jacket, and wherein ribs (15) are provided on a portion of the wall where the EGR passage extends in such a manner as to protrude into the water jacket.

According to this construction, since the ribs function as heat radiating fins, the cooling efficiency can be improved, and moreover an improvement in the rigidity of the cylinder head with the ribs can be attempted.

According to a third aspect of the invention, there is provide an engine cylinder head as set forth in the first or second aspect of the invention, wherein the EGR passage is contiguous with boss portions (11) where the head bolt pass-through holes are formed.

According to this construction, no reduction in the rigidity of the cylinder head has to be called for even if the EGR passage is formed in the cylinder head.

According to a fourth aspect of the invention, there is provided an engine cylinder head in which a water jacket and an exhaust gas recirculation passage are formed therein, the exhaust gas recirculation passage opening into an exhaust passage at one end and opening into a side of an intake side at the other end thereof, the engine cylinder being characterized in that the cylinder head comprises a plurality of exhaust ports in each combustion chamber, and wherein the one end of the exhaust gas recirculation passage opens into a collecting portion (14) of exhaust passages extending from the plurality of exhaust ports, respectively.

According to this construction, the length of the passage can be made far longer than that in the cylinder head in which the EGR passage is made to open in a side which is closer to the combustion chamber than the collecting portion.

DETAILED DESCRIPTION OF THE PREFERRED EMBODIMENTS

The invention will be described in detail with reference to the appended drawings.

Figure 1:
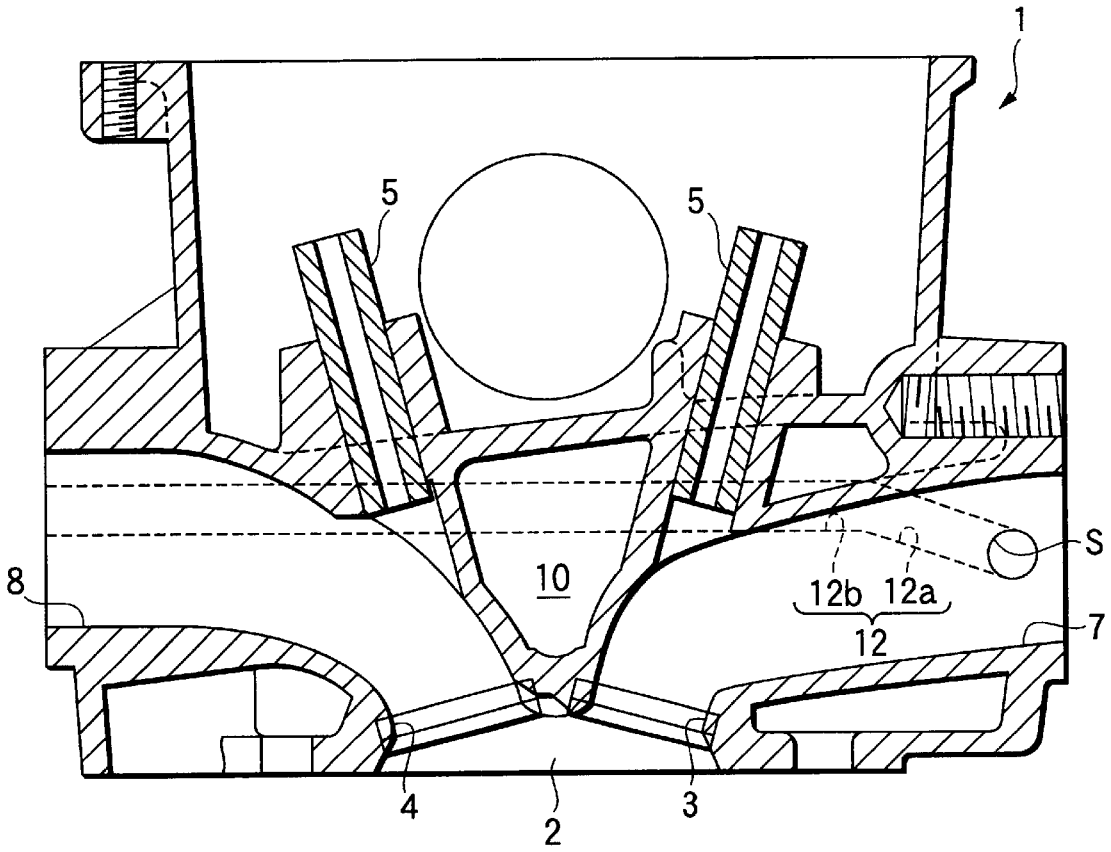
FIG. 1 is a cross-sectional view of a cylinder head according to the invention taken along a plane which is in parallel to the axis of a cylinder and which passes through the centers of both intake and exhaust valves.
Figure 2:
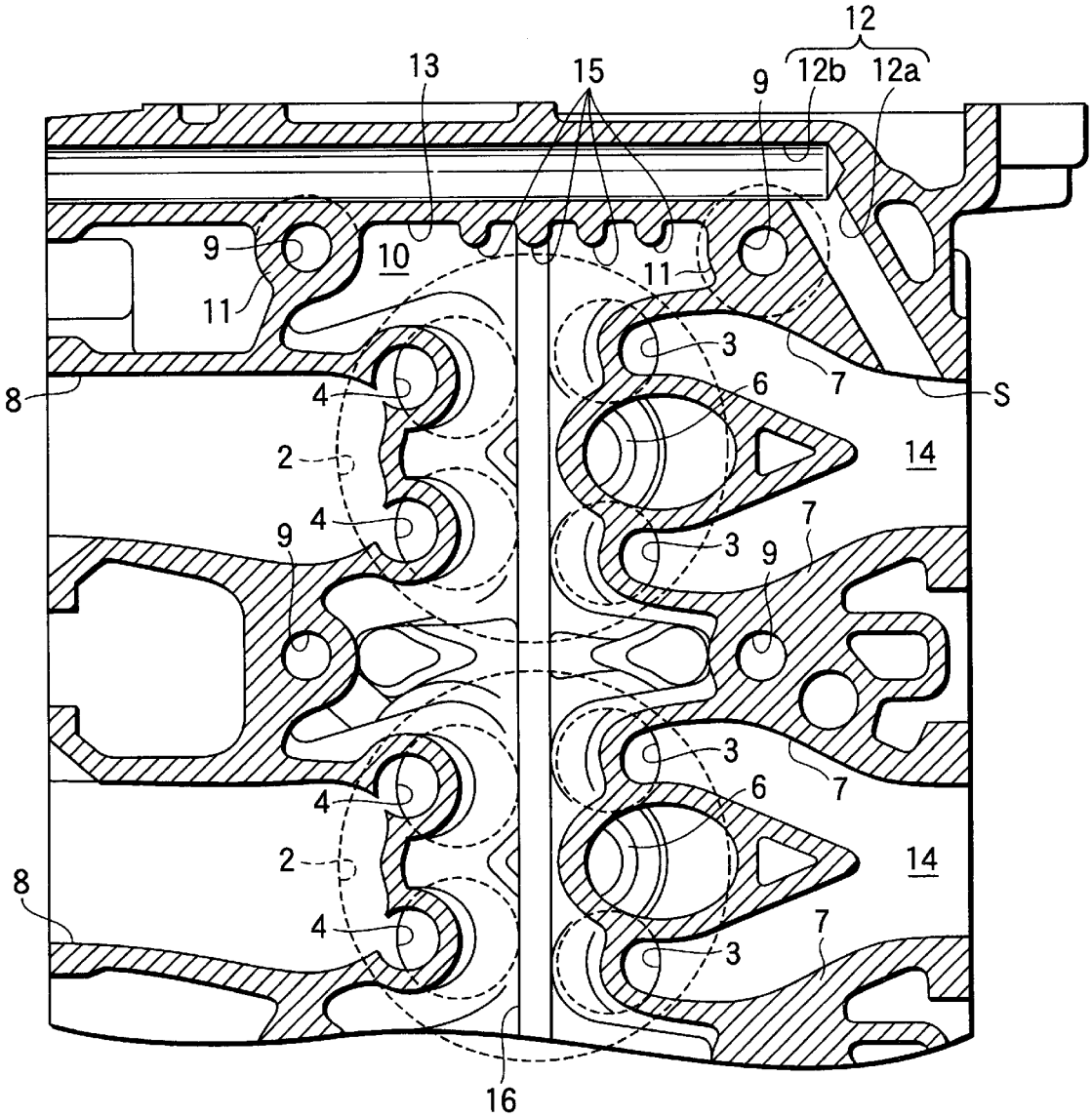
FIG. 2 is a cross-sectional view of a main portion of the cylinder head according to the invention taken along a plane which intersects with axes of cylinders at right angles and which passes the center of an EGR passage.

FIGS. 1 and 2 show a cylinder head of an in-line multi-cylinder engine according to the invention.

A lower surface, that is, a joint surface with a cylinder block (not shown) of a cylinder head 1 is caved to form combustion chambers 2 in such a manner as to correspond to cylinders, respectively. Exhaust ports 3 and intake ports 4, two for each, open to each combustion chamber 2. Valve guides 5 are provided on axes passing through the centers of the exhaust port 3 and the intake port 4, respectively. In addition, a spark plug mounting hole 6 is formed at a position held by the two exhaust ports 3.

An exhaust passage 7 and an intake passage 8 extending, respectively, from the exhaust ports 3 and the intake ports 4 open to side surfaces of the cylinder head 1 which are parallel to each other in the cylinder arrangement direction. Here, the. exhaust passages 7 extend individually from the two exhaust ports 3 and thereafter collect together at a position downstream of head bolt pass-through holes which are to be described later.

Head bolt pass-through holes 9 are opened in the cylinder head along a circumference which surrounds each combustion chamber 2. Those of the holes 9 which are provided at one end of the cylinder head in the cylinder arrangement direction are opened in the centers of boss portions 11 which are provided in such a manner as to vertically pass through a water jacket 10 defined within the cylinder head 1 (refer to FIG. 3).

An EGR passage 12 is provided at the one end of the cylinder head in the cylinder arrangement direction for re-circulating a part of exhaust gases from the combustion chambers 2 to the intake system. The EGR passage 12 is formed in a thick portion 13 formed on a wall constituting the water jacket 10 in such a manner as to protrude into the water jacket 10. The EGR passage 12 includes an upstream side portion 12*a* which is drilled to be opened diagonally from an inner circumferential wall of the exhaust passage 7 located on one side of the cylinder head 1 by way of an opening in the exhaust passage 7 and a downstream side portion 12*b* which is drilled to be opened straight from the other side of the cylinder head 1 to which the intake passage 8 opens. These two portions 12*a*, 12*b* are connected to each other at inner ends thereof so that the exhaust passage 7 at the one end of the cylinder head 1 in the cylinder arrangement direction and the other side of the cylinder head 1 are allowed to communicate with each other. Note that an EGR valve (not shown) is connected to the intake side of this passage 12.

As has been described above, since a contact area with cooling water can be increased by expanding the thick portion 13 into the water jacket 10, the heat exchange capacity can be increased. Incidentally, the length of the thick portion 13 within the water jacket 10 may be determined suitably in consideration of the heat exchange capacity.

Figure 3:
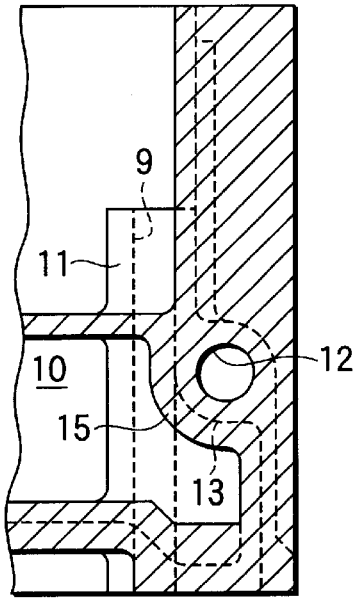
FIG. 3 is a cross-sectional view of the main portion of the cylinder head according to the invention taken along a plane which is in parallel to a row of cylinders and which passes through the centers of combustion chambers.

On the other hand, as shown in FIG. 3, the thick portion 13 where the EGR passage 12 is formed is connected to the boss portion 11 located at the one end of the cylinder head 1 in the cylinder arrangement direction where a head bolt pass-through hole 9 is formed, whereby no reduction in rigidity of the cylinder head 1 is caused, even if the EGR passage 12 is formed in the cylinder head 1.

A plurality of ribs 15 are formed in such a manner as to connect to the wall surface of the water jacket 10 at a portion between both the boss portions 11 on the thick portion 13. The ribs 15 are formed into arc-like configurations which are concentric with the center of the EGR passage 12 and connect an upper wall and a side wall of the water jacket 10 to each other. In addition, one of the ribs 15 is connected to a rib 16 provided on a bottom surface of the water jacket 10 in such a manner as to extend in the cylinder arrangement direction.

Thus, since the ribs 15 are provided between the boss portions 11 for provision of the head bolt pass-through holes, the improvement in cooling efficiency can be realized through cooling fin operation without increasing the flowing resistance of cooling water within the water jacket 10. Moreover, the rigidity of the entirety of the cylinder head 1 as well as the wall constituting the water jacket 10 can be enhanced further.

The upstream side portion 12*a* of the EGR passage originates from a collecting portion 14 of the two exhaust passages 7 located downstream of the locations of the head bolt pass-through holes 9 as a commencement end S. Thus, generation of non-uniformity in exhaust gas constituents to be re-circulated to the intake system can be avoided, and moreover enhancement of the degree of freedom in designing cylinder heads for engines in which a valve stop mode is incorporated can be attempted. In addition, as described above, the EGR passage 12 is disposed such that the passage extends outwardly of the head bolts pass-through holes over its full length, whereby the length of the passage can be made as long as possible, and moreover head bolts (not shown) can be disposed closer to the periphery of the combustion chamber 2 so that the surface pressure around the combustion chambers relative to the cylinder block can be enhanced.

Figure 4:
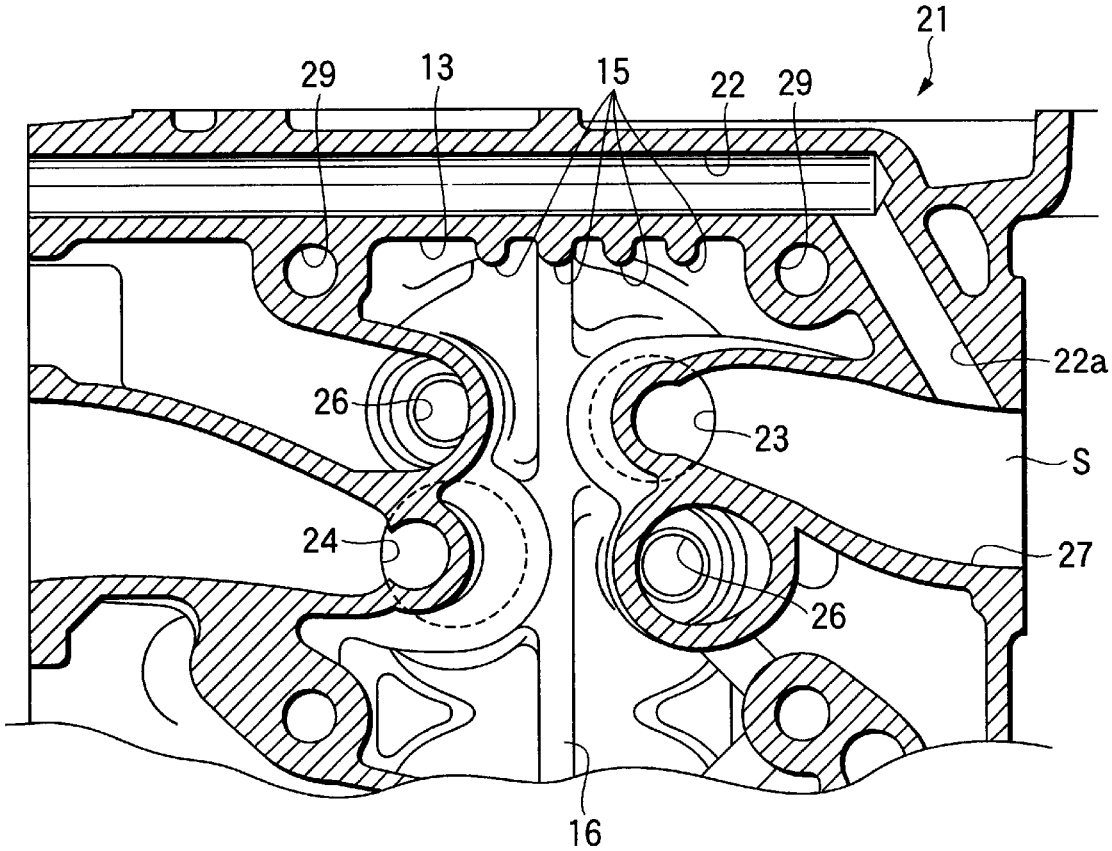
FIG. 4 is a cross-sectional view of a main portion of another cylinder head according to the invention, which is similar to FIG. 2.

Thus, while the invention has been described as being applied to the cylinder head 1 in which the exhaust ports 3 and intake ports 4, two for each, are provided in each combustion chamber 2, the invention may be applied even to a cylinder head in which an intake valve and an exhaust valve are provided in each combustion chamber. Specifically, as shown in FIG. 4, an EGR passage 22 can be provided so as to extend outwardly of head bolt pass-through holes 29 formed in the cylinder head at one end thereof in the cylinder arrangement direction. In this case, since there is provided only a single exhaust passage 27, a commencement end S of the EGR passage 22 may be located anywhere in the exhaust passage 27 as long as an upstream side portion 22*a* of the EGR passage 22 can be passed through outwardly of the head bolt pass-through holes 29. Incidentally, in the cylinder head 21 shown in FIG. 4, while spark plug mounting holes 26 are provided for an exhaust port 23 and an intake port 24, respectively, in such a manner as to be contiguous therewith, it is needless to say that the invention may be applied even to a cylinder head in which a single spark plug mounting hole is provided in each combustion chamber.

As has been described in detail heretofore, according to the first aspect of the invention, since the EGR passage is provided outwardly of the head bolt pass-through holes formed in the cylinder head at the one end thereof in the cylinder arrangement direction, the length of the passage can be made as long as possible. Consequently, not only can the cooling capacity for re-circulating gases be improved but also the EGR passage can be formed without the head bolts being spaced apart from the combustion chamber, whereby the surface pressure around the combustion chambers in the cylinder head relative to the cylinder block can be prevented from being lowered.

In addition, according to the second aspect of the invention, the EGR passage is formed in, for example, the thick portion formed on the wall of the water jacket, and the ribs are provided on the portion where the EGR passage extends in such a manner as to protrude into the water jacket. Thus, the ribs can function as heat radiating fins, so that the cooling efficiency can be improved, and moreover, the rigidity of the cylinder head can be improved with the ribs.

Furthermore, according to the third aspect of the invention, the EGR passage is connected to the boss portion where the head bolt pass-through hole is formed, and therefore even with the EGR passage being formed therein, no reduction in rigidity of the cylinder head is caused.

Then, according to the fourth aspect of the invention, the plurality of exhaust ports are provided in each combustion chamber, and the EGR passage is opened at the one end thereof to the collecting portion of the exhaust passages extending from the plurality of exhaust ports, respectively.

Thus, since the length of the EGR passage can be made longer than that of an EGR passage which is opened closer to the combustion chamber side than to the collecting portion, the cooling performance can be improved further.

As has been described heretofore, according to the invention, the EGR passage and EGR valve can be restrained from being narrowed and deteriorated, respectively, and therefore, the invention becomes extremely effective in maintaining good fuel economy and exhaust emissions purifying performance over a long period of time.

What is claimed is:

1. An engine cylinder head in which a water jacket and an exhaust gas recirculation passage are formed therein, wherein said exhaust gas recirculation passage is opened into an exhaust passage at one end thereof and is opened into a side surface of an intake side at the other end thereof, wherein a head bolt pass-through hole is formed in one end of said cylinder head in a cylinder arrangement direction, wherein said exhaust gas recirculation passage is provided outwardly of said head bolt pass-through hole in: the cylinder arrangement direction, and wherein said exhaust gas recirculation passage communicates with said exhaust passage through the outside, in the cylinder arrangement direction, of said head bolt pass-though hole disposed on an exhaust side of said cylinder head.

2. The engine cylinder head as set forth in claim 1, wherein at least one part of said exhaust gas recirculation passage is formed in a wall constituting said water jacket, and wherein at least one rib is provided on a portion of said wall where said exhaust gas recirculation passage extends in such a manner as to protrude into said water jacket.

3. The engine cylinder head as set forth in claim 2, wherein said head bolt pass-through hole comprises a plurality of head bolt pass-though holes formed in the one end of said cylinder head in the cylinder arrangement direction, and wherein said exhaust gas recirculation passage communicates with said exhaust passage through the outside of-said plurality of head bold pass-through holes in the cylinder arrangement direction.

4. The engine cylinder head as set forth in claim 2, wherein said exhaust gas recirculation passage is in contact with a boss portion where said head bolt pass-through hole is formed.

5. The engine cylinder head as set forth in claim 4, wherein said head bolt pass-through hole comprises a plurality of head bolt pass-though holes formed in the one end of said cylinder head in the cylinder arrangement direction, and wherein said exhaust gas recirculation passage communicates with said exhaust passage through the outside of said plurality of head bold pass-through holes in the cylinder arrangement direction.

6. The engine cylinder head as set forth in claim 1, wherein said exhaust gas recirculation passage is in contact with a boss portion where said head bolt pass-through hole is formed.

7. The engine cylinder head as set forth in claim 6, wherein said head bolt pass-through hole comprises a plurality of head bolt pass-through holes formed in the one end of said cylinder head in the cylinder arrangement direction, and wherein said exhaust gas recirculation passage communicates with said exhaust passage through the outside of said plurality of head bolt pass-through holes in the cylinder arrangement direction.

8. The engine cylinder head as set forth in claim 1, wherein said head bolt pass-through hole comprises a plurality of head bolt pass-though holes formed in the one end of said cylinder head in the cylinder arrangement direction, and wherein said exhaust gas recirculation passage communicates with said exhaust passage through the outside of said plurality of head bold pass-through holes in the cylinder arrangement direction.

9. An engine cylinder head in which a water jacket and an exhaust gas recirculation passage are formed therein, wherein said exhaust gas recirculation passage is opened into an exhaust passage at one end thereof and is opened into a side surface of an intake side at the other end thereof, wherein said cylinder head comprises a plurality of exhaust ports in each combustion chamber, wherein said one end of said exhaust gas recirculation passage opens into a collecting portion of exhaust passages extending from said plurality of exhaust ports, respectively, and said exhaust gas recirculation passage is provided outwardly, in a cylinder arrangement direction, of a head bolt pass-through hole disposed on an exhaust side of one end of said cylinder head in a cylinder arrangement direction.

10. The engine cylinder head as set forth in claim 9, wherein at least one part of said exhaust gas recirculation passage is formed in a wall constituting said water jacket, and wherein at least one rib is provided on a portion of said wall where said exhaust gas recirculation passage extends in such a manner as to protrude into said water jacket.

11. The engine cylinder head as set forth in claim 10, wherein a plurality of head bolt pass-through holes are formed in one end of said cylinder head in the cylinder arrangement direction, and wherein said exhaust gas recirculation passage communicates with said exhaust passage through the outside of said plurality of head bolt pass-through holes in the cylinder arrangement direction.

12. The engine cylinder head as set forth in claim 10, wherein said exhaust gas recirculation passage is in contact with a boss portion where said head bolt pass-through hole is formed.

13. The engine cylinder head as set forth in claim 12, wherein a plurality of head bolt pass-through holes are formed in one end of said cylinder head in the cylinder arrangement direction, and wherein said exhaust gas recirculation passage communicates with said exhaust passage through the outside of said plurality of head bolt pass-through holes in the cylinder arrangement direction.

14. The engine cylinder head as set forth in claim 9, wherein said exhaust gas recirculation passage is in contact with a boss portion where said head bolt pass-through hole is formed.

15. The engine cylinder head as set forth in claim 14, wherein a plurality of head bolt pass-through holes are formed in one end of said cylinder head in a cylinder arrangement direction, and wherein said exhaust gas recirculation passage communicates with said exhaust passage through the outside of said plurality of head bolt pass-through holes in the cylinder arrangement direction.

16. The engine cylinder head as set forth in claim 9, wherein a plurality of head bolt pass-through holes are formed in one end of said cylinder head in the cylinder arrangement direction, and wherein said exhaust gas recirculation passage communicates with said exhaust passage through the outside of said plurality of head bolt pass-through holes in the cylinder arrangement direction.

* * * * *